US011834301B2

(12) United States Patent
Li et al.

(10) Patent No.: US 11,834,301 B2
(45) Date of Patent: Dec. 5, 2023

(54) GUIDE DEVICE FOR AN ELEVATOR CAR AND ELEVATOR SYSTEM

(71) Applicant: Otis Elevator Company, Farmington, CT (US)

(72) Inventors: Bichun Li, Shanghai (CN); Shenhong Wang, Shanghai (CN); Yunru Chen, Suzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/775,719

(22) PCT Filed: Dec. 8, 2020

(86) PCT No.: PCT/CN2020/134636
§ 371 (c)(1),
(2) Date: May 10, 2022

(87) PCT Pub. No.: WO2021/121084
PCT Pub. Date: Jun. 24, 2021

(65) Prior Publication Data

US 2022/0402728 A1 Dec. 22, 2022

(30) Foreign Application Priority Data

Dec. 16, 2019 (CN) ..... 201922256627.4
Apr. 30, 2020 (CN) ..... 202010362393.6

(51) Int. Cl.
*B66B 7/04* (2006.01)
*B66B 11/02* (2006.01)

(52) U.S. Cl.
CPC ..... *B66B 7/046* (2013.01); *B66B 11/0293* (2013.01)

(58) Field of Classification Search
CPC ..... B66B 7/046; B66B 11/0293
See application file for complete search history.

(56) References Cited

U.S. PATENT DOCUMENTS 1,854,976 A * 4/1932 Brady ..... B66B 7/048 187/406
3,783,978 A * 1/1974 Hamilton ..... B66B 7/048 200/61.45 R (Continued)

FOREIGN PATENT DOCUMENTS

JP 2003104655 A 4/2003
JP 2005126163 A 5/2005

(Continued)

OTHER PUBLICATIONS

JP2009208914—Machine Translation (Year: 2009).*

(Continued)

*Primary Examiner* — Michael A Riegelman
(74) *Attorney, Agent, or Firm* — CANTOR COLBURN LLP

(57) ABSTRACT

The present disclosure provides a guide device for an elevator car, and an elevator system. The guiding device includes: a roller guide frame; and at least one roller rotatably mounted to the roller guide frame, the roller being configured to roll on an elevator guide rail when the elevator car is moving; wherein the guiding device further includes a braking device which inhibits the rotation of the roller when activated. The device according to the embodiment of the present disclosure has a simple and compact structure.

13 Claims, 10 Drawing Sheets

(56) References Cited

U.S. PATENT DOCUMENTS 5,117,946 A * 6/1992 Traktovenko ..... B66B 7/046 187/410
5,632,358 A * 5/1997 Maeda ..... B66B 7/048 187/410
5,950,771 A * 9/1999 Ferrisi ..... B66B 7/048 187/409
6,474,449 B1 * 11/2002 Utsunomiya ..... B66B 7/042 187/292
RE38,835 E * 10/2005 Sevilleja ..... B66D 5/08 187/350
7,398,863 B2 * 7/2008 Liebetrau ..... B66B 7/046 187/372
8,011,478 B2 * 9/2011 Utsunomiya ..... B66B 7/042 187/292
8,869,946 B2 * 10/2014 Okada ..... B66B 5/22 187/350
9,862,569 B2 * 1/2018 Vlasov ..... B66B 5/00
10,214,382 B2 * 2/2019 Wei ..... B66B 1/36
10,215,242 B2 * 2/2019 Polack ..... B60T 13/748
2009/0032340 A1 * 2/2009 Smith ..... B66B 7/042 188/73.31
2009/0308697 A1 * 12/2009 Boschin ..... B66B 7/044 187/409
2011/0272223 A1 * 11/2011 Drayer ..... B66B 5/044 188/65.1
2015/0291392 A1 * 10/2015 Steiner ..... B66B 7/046 187/410
2017/0355563 A1 * 12/2017 Zimmerli ..... B66B 7/08
2022/0135374 A1 * 5/2022 Li ..... B66B 7/046 187/351
2022/0402728 A1 * 12/2022 Li ..... B66B 7/046
2023/0047079 A1 * 2/2023 Duvall ..... B66B 11/0293

FOREIGN PATENT DOCUMENTS

JP 2006264852 A 10/2006
JP 2009208914 A 9/2009

OTHER PUBLICATIONS

2005126163—Machine translation (Year: 2005).*
International Search Report for Application No. PCT/CN2020/134636; dated Apr. 1, 2021; 4 Pages.
Written Opinion for Application No. PCT/CN2020/134636; dated Apr. 1, 2021; 6 Pages.

* cited by examiner

GUIDE DEVICE FOR AN ELEVATOR CAR AND ELEVATOR SYSTEM

CROSS-REFERENCE TO RELATED APPLICATIONS

This application is a 371 U.S. National Stage application of PCT/CN2020/134636, filed Dec. 8, 2020, which claims the benefit to Chinese Application No. 202010362393.6, filed Apr. 30, 2020 and Chinese Application No. 201922256627.4, filed Dec. 16, 2019, all of which are incorporated by reference in their entirety herein.

FIELD OF THE INVENTION

The present disclosure relates to the field of elevators, and more specifically, the present disclosure relates to a device and a system for keeping the elevator stable when it is parked.

BACKGROUND OF THE INVENTION

In high-rise buildings, the elevator has a longer traveling distance. When the elevator car is on a low floor, the length of a rope between an elevator car and a tractor becomes longer. This rope will inevitably stretch or shorten when the weight of the passengers in the elevator car changes. Therefore, when passengers enter and exit the elevator, they will feel the springing or vibrating of the elevator car for example caused by the deformation of the rope.

SUMMARY OF THE INVENTION

An object of the present disclosure is to solve or at least alleviate the problems existing in the related art.

According to an aspect, a guiding device for an elevator car is provided, which includes:

a roller guide frame; and at least one roller rotatably mounted to the roller guide frame, the roller being configured to roll on an elevator guide rail when the elevator car is moving;

wherein the guiding device further includes a braking device which inhibits the rotation of the roller when activated.

Optionally, the guiding device for the elevator car further includes a control device, wherein the control device is coupled with the braking device, and the control device is configured to activate the braking device when elevator car is parked and release the braking device before the elevator car starts to move.

Optionally, in the guiding device for the elevator car, the control device is configured to activate the braking device when the elevator car is parked and during the opening of the car door, and release the braking device during the closing of the car door and/or when the elevator is in a standby state.

Optionally, in the guiding device for the elevator car, the braking device includes:

a braking module including a friction member capable of switching between a braking position and an idle position, wherein when the friction member is in the braking position, the friction member acts on the at least one roller by friction to inhibit the rotation of the at least one roller, and when the friction member is in the idle position, it is separated from the at least one roller;

a pull wire connected to the friction member; and a brake which is connected to the pull wire and which is capable of pulling the pull wire so as to cause the friction member of the braking module to move from the idle position to the braking position.

Optionally, in the guiding device for the elevator car, the at least one roller includes a first roller and a second roller arranged side by side, wherein the first roller and the second roller have a gap therebetween to accommodate the guide rail, spring means between the rollers and the guide rail are pre-compressed by certain distances to ensure that the rollers closely abut the working surfaces of the guide rail, and when the braking device is activated, it acts on both the first roller and the second roller at the same time.

Optionally, in the guiding device for the elevator car, the braking device includes a first braking module acting on the first roller and a second braking module acting on the second roller, wherein the first braking module and the second braking module are respectively connected to the same brake via the pull wire.

Optionally, in the guiding device for the elevator car, the friction member acts on an outer ring of a roller body of the at least one roller.

Optionally, in the guiding device for the elevator car, the friction member acts on a hub of the at least one roller.

Optionally, in the guiding device for the elevator car, the friction member acts on a rotating shaft of the at least one roller or an accessory fixed to the rotating shaft of the at least one roller.

According to another aspect, an elevator system is also provided, which includes:

an elevator car;

a tractor for driving the elevator car to move; and the guiding device for the elevator car according to various embodiments, which is connected to the elevator car to guide the elevator car to move along the guide rail.

Optionally, the tractor is connected to the elevator car by a rope belt having a plurality of ropes integrated therein.

According to another aspect, an elevator rail clamping device is provided, which includes a roller guide shoe and a braking device installed on the roller guide shoe; the braking device includes a brake, and the brake is set on one side of a guide wheel on the roller guide shoe, the brake pad on the brake is arranged close to the wheel edge of the guide wheel.

Optionally, the brake device further includes a drive mechanism matched with the brake; the brake includes a brake box and the brake pad; the brake pad is curved, and the middle portion of the brake pad is rotatably connected to the brake box, the first end of the brake pad is connected to the drive mechanism, and the second end of the brake pad is arranged close to the wheel edge of the guide wheel.

Optionally, the drive mechanism includes a push-pull electromagnet and a brake wire; the first end of the brake pad is connected to one end of the brake wire, and the other end of the brake wire is connected to the push-pull end of the push-pull electromagnet.

Optionally, the brake further includes a compression spring; the brake pad is placed in the brake box, the first end of the brake pad is connected to one end of the compression spring, and the other end of the compression spring is connected to an inner side wall of the brake box; one end of the brake wire passes through the compression spring and is connected to the first end of the brake pad.

Optionally, the roller guide shoe includes a frame and three guide wheels installed on the frame, and the wheel edges of the three guide wheels are opposite to each other and enclose a clamping channel.

Optionally, the brake includes two brakes, and the two brakes are arranged on one side of two of the guide wheels respectively; the first end of the brake pad in each brake is correspondingly connected to the push-pull end of the push-pull electromagnet by a brake wire.

Optionally, the central axes of the first and second guide wheels are parallel, and the central axis of the third guide wheel is perpendicular to the central axis of the first guide wheel; the two brakes are correspondingly arranged on one side of the first and second guide wheels.

BRIEF DESCRIPTION OF THE DRAWINGS

The contents of the present disclosure will become easier to understand with reference to the accompanying drawings. It can be easily understood by those skilled in the art that the drawings are merely used for illustration, and are not intended to limit the scope of protection of the present disclosure. In addition, like parts are denoted by like numerals in the drawings, wherein.

DETAILED DESCRIPTION OF THE EMBODIMENT(S) OF THE INVENTION

Figure 1:
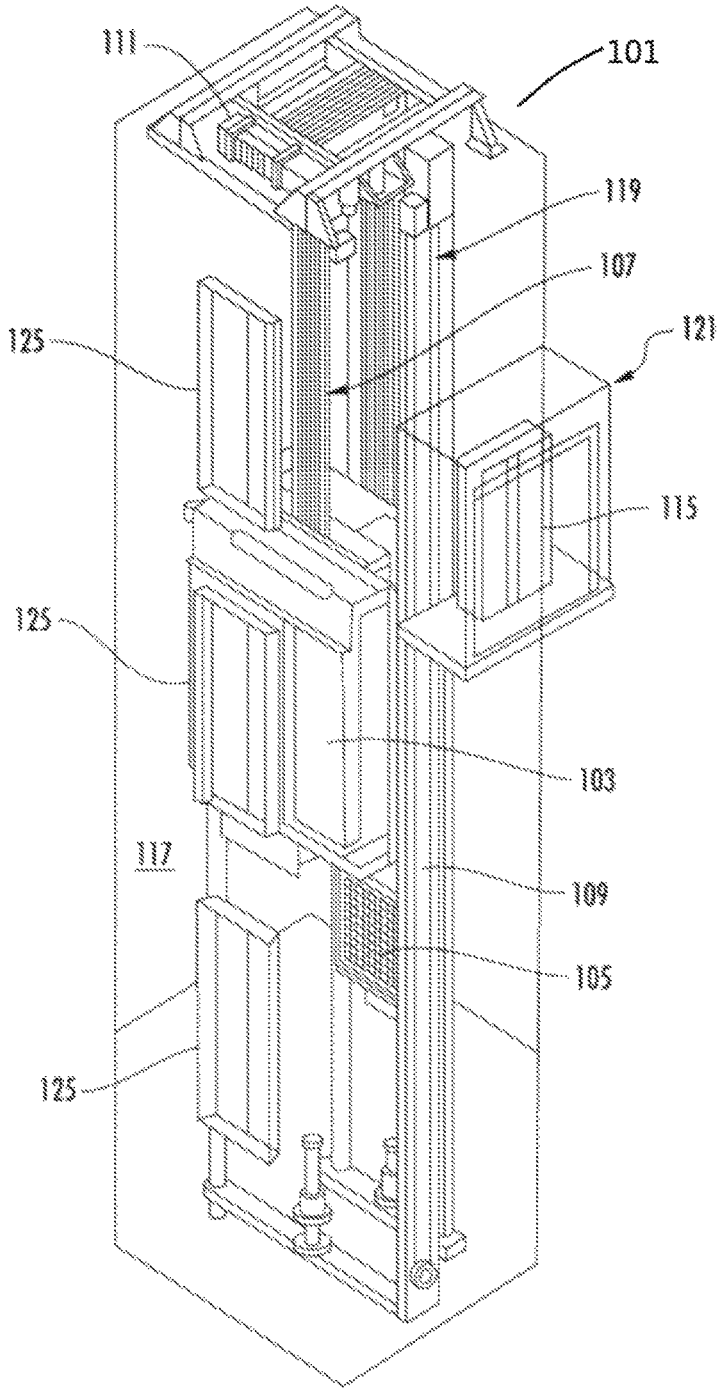
FIG. 1 is a schematic view of an exemplary elevator system.

FIG. 1 is a perspective view of an elevator system 101, which includes an elevator car 103, a counterweight 105, a rope 107, a guide rail 109, a tractor 111, and an elevator system controller 115. The elevator car 103 and the counterweight 105 are connected to each other via the rope 107. The rope 107 may include or be configured as, for example, a cord, a steel cable, and/or a coated steel belt. In this embodiment, the rope is configured as a rope belt have a plurality of ropes integrated therein. The counterweight 105 is configured to balance the load of the elevator car 103, and is configured to move simultaneously with the elevator car 103 in an opposite direction to the elevator car 103 when the elevator car 103 is traveling in an elevator hoistway 117 relative to the counterweight 105 along the guide rail 109. The rope 107 engages with the tractor 111, which is part of the top structure of the elevator system 101. The tractor 111 is configured to control the movement between the elevator car 103 and the counterweight 105.

The elevator system controller 115 is positioned within an elevator system controller room 121 of the elevator hoistway 117 as shown, and is configured to control the operation of the elevator system 101, in particular the operation of the elevator car 103. For example, the elevator system controller 115 may provide a driving signal to the tractor 111 to control the acceleration, deceleration, leveling, parking and the like of the elevator car 103. When the elevator car 103 is moving upward or downward in the elevator hoistway 117 along the guide rail 109, the elevator car 103 can be parked at one or more landings 125 under the control of the elevator system controller 115. Although the elevator system controller 115 is shown in the elevator system controller room 121, those skilled in the art will understand that the elevator system controller 115 may be located and/or configured at other positions or locations within the elevator system 101. The tractor 111 may include a motor or a similar drive mechanism.

Although the rope system is illustrated and described, the embodiments of the present disclosure may also be implemented in elevator systems that employ other methods and mechanisms for moving the elevator car within the elevator hoistway. FIG. 1 merely shows a non-limiting example presented for illustrative and explanatory purposes.

Figure 2:
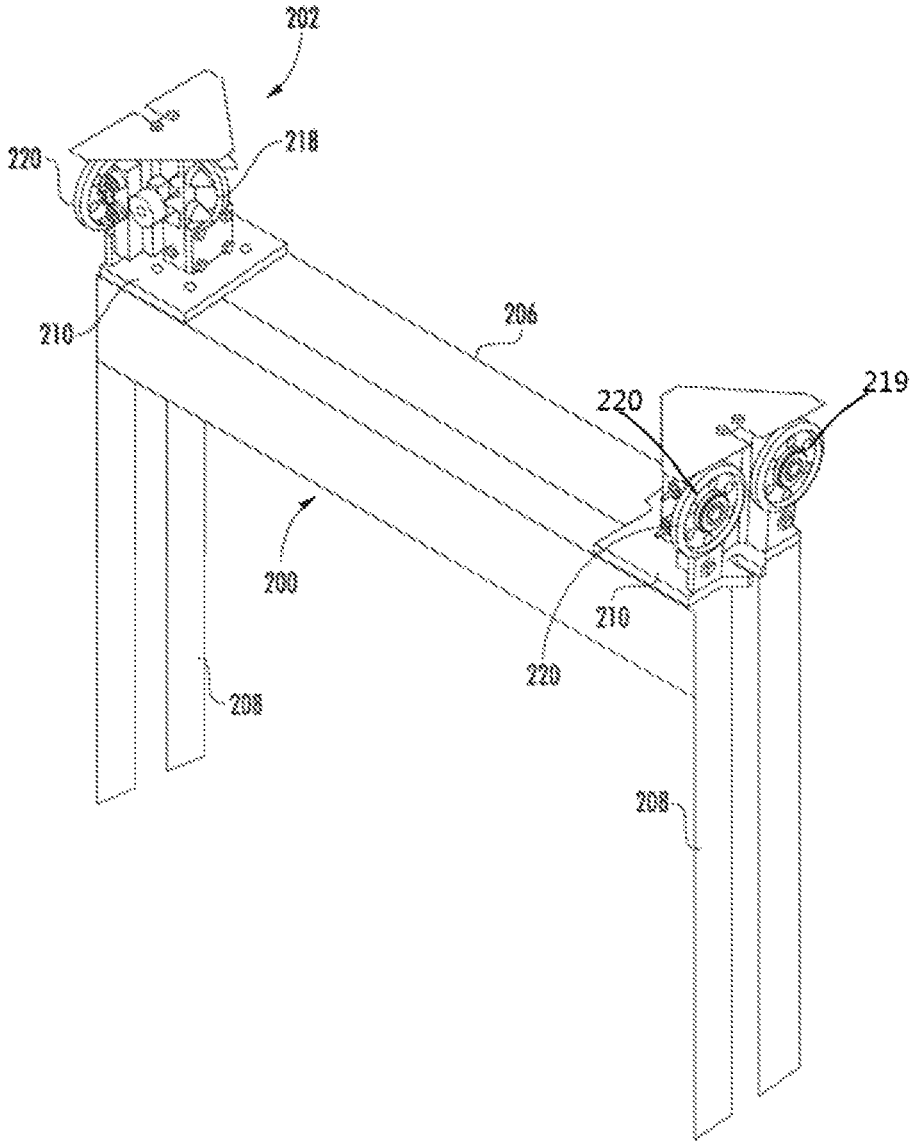
FIG. 2 is a perspective view of an exemplary guiding device for an elevator car.
Figure 3:
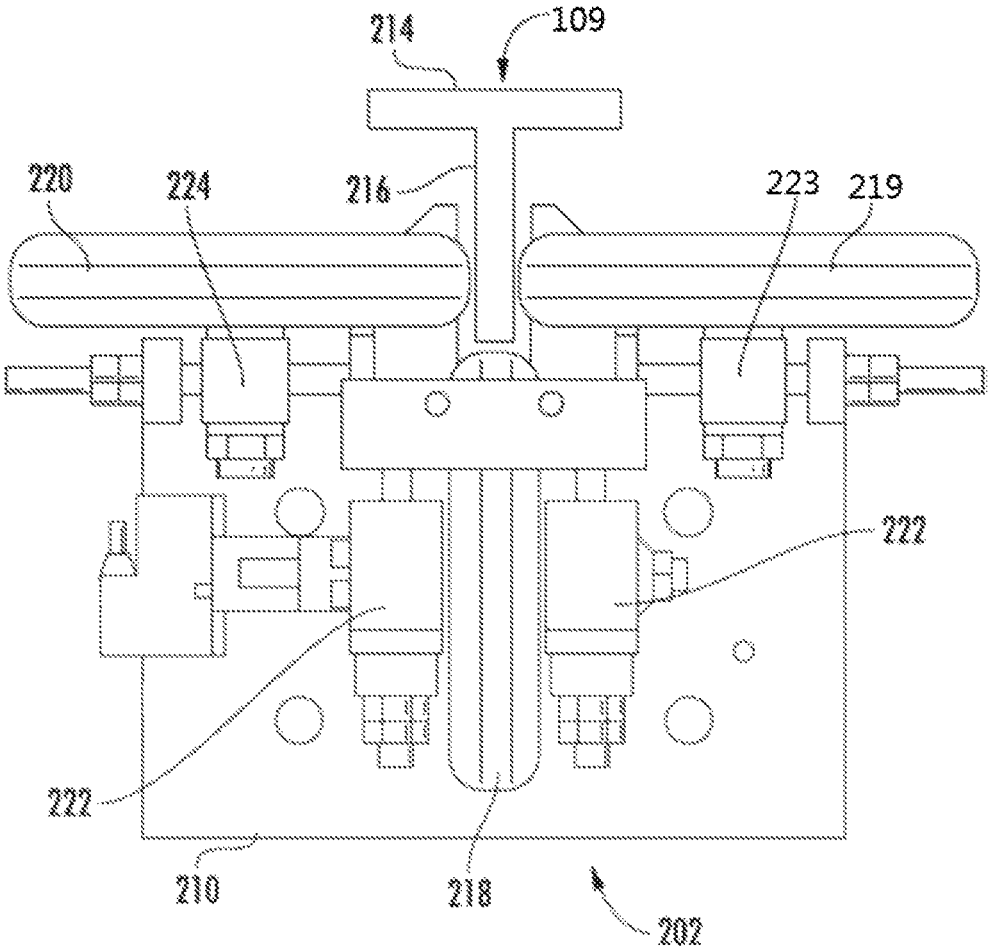
FIG. 3 is a schematic view illustrating how the guiding device for the elevator car is engaged with a guide rail.
Figure 4:
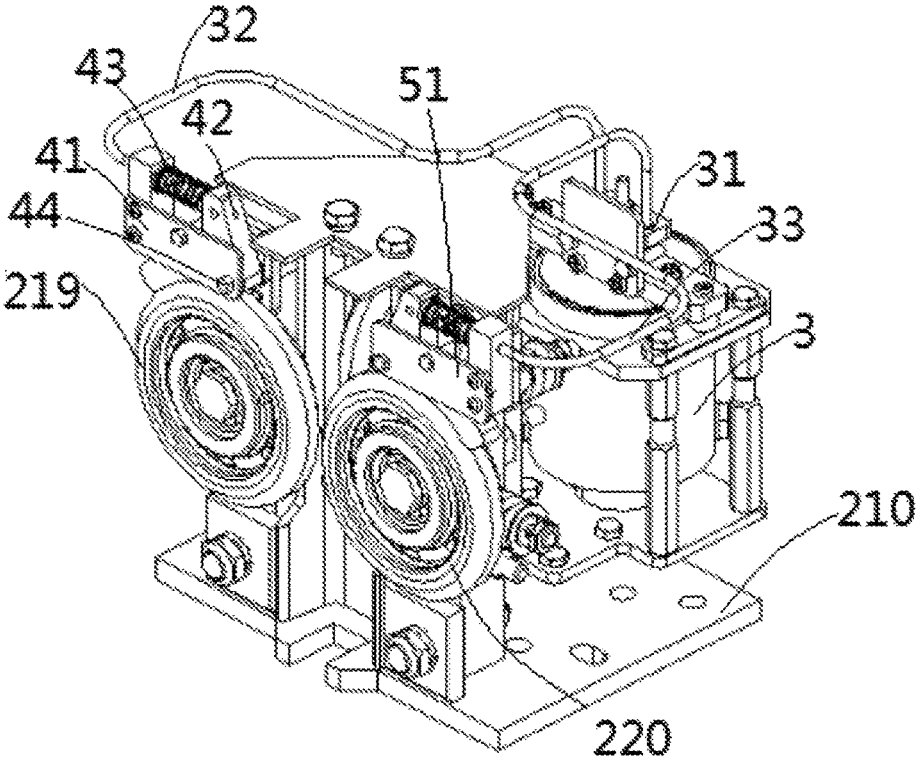
FIG. 4 is a perspective view of a guiding device according to an embodiment.
Figure 5:
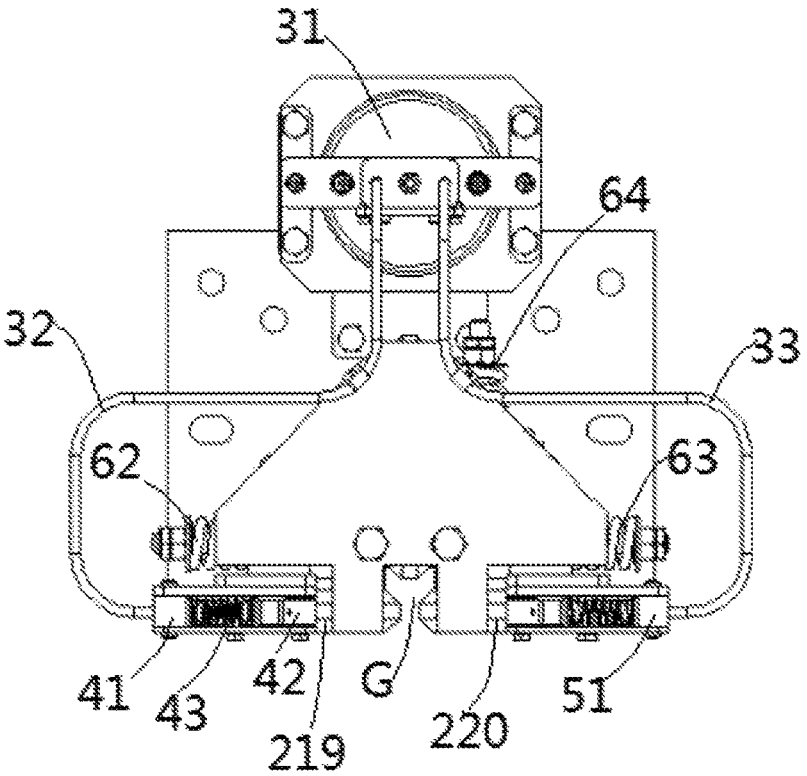
FIG. 5 is a top view of a guiding device according to an embodiment.
Figure 6:
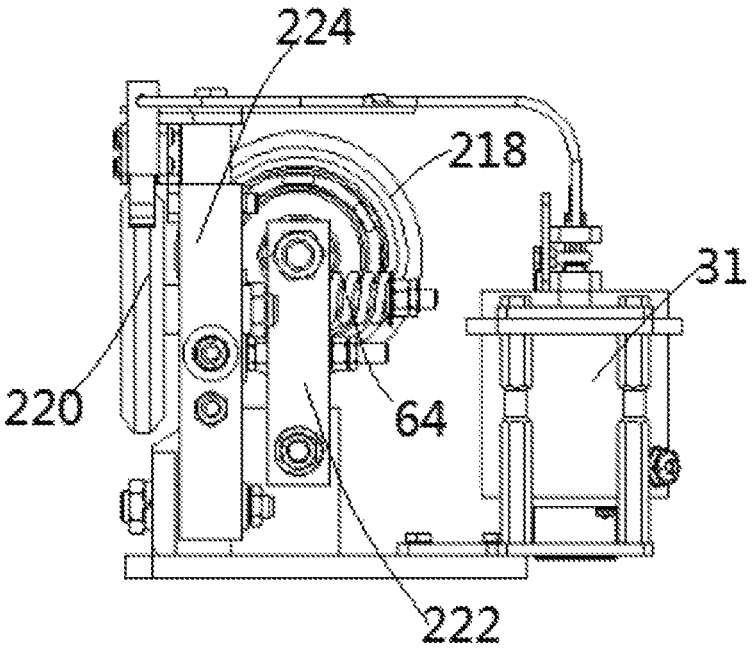
FIG. 6 is a side view of a guiding device according to an embodiment.
Figure 7:
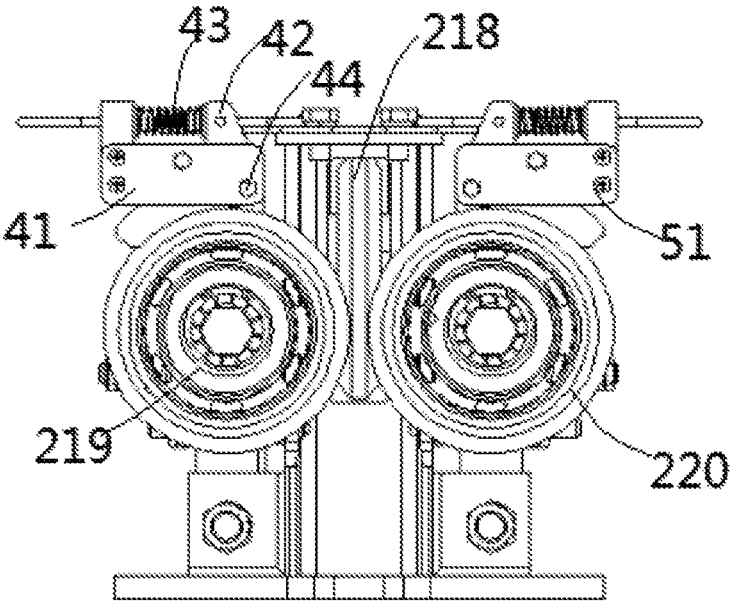
FIG. 7 is a front view of a guiding device according to an embodiment.

Turning now to FIGS. 2 and 3, FIG. 2 is a partial perspective view of an elevator car frame 200 on which two guiding devices 202 for the elevator car are mounted, and FIG. 3 is a schematic top view of the guiding devices 202 for the elevator car when engaging with the guide rail 109 of the elevator system. The elevator car frame 200 includes a horizontal frame 206 extending between a pair of vertical frames 208. The guiding devices 202 for the elevator car are mounted to at least one of the horizontal frame 206 and the vertical frames 208 at a mounting base in a manner known in the art. The mounting base defines at least a part of a roller guide frame 210, or the roller guide frame 210 is mounted to the mounting base. The mounting base is configured to mount and support the guiding devices 202 with at least one roller to the elevator car. Although only a pair of guiding devices 202 located at the top of the elevator car are shown in FIG. 2, optionally, a pair of guiding devices may also be provided at the bottom or middle portion of the elevator car, or two or more pairs of guiding devices 202 may be located at the top, middle portion and/or bottom of the elevator car respectively.

The guiding devices 202 for the elevator car are each configured to engage with and move along the guide rail 109 (FIG. 3). The guide rail 109 has a base 214 and a sheet-like engaging portion 216, and the rollers of the guiding device 202 for the elevator car engage with and roll along the respective surfaces of the engaging portion 216 of the guide rail 109. For example, the guiding device 202 for the elevator car shown in FIG. 3 includes a first roller 219, a second roller 220, and a third roller 218, which engage with three different surfaces of the guide rail 109 respectively. In the current configuration, as understood by those skilled in the art, the third roller 218 is a lateral roller, and the first roller 219 and the second roller 220 are front and rear rollers. Although specific configurations are shown in FIGS. 2 and 3, those skilled in the art will understand that the embodiments provided herein may be applicable to various other configurations of the guiding device for the elevator car.

The respective rollers 218, 219 and 220 are rotatably mounted to the roller guide frame 210 via support brackets 222, 223 and 224, respectively. In addition, spring mechanisms are provided, which are configured to provide a restoring force for each roller and limit their displacements. An outer ring of a roller body of the roller contacts the guide rail of the elevator system and rolls along the surface of the guide rail with the vertical movement of the elevator car.

With continued reference to FIGS. 4 to 7, the guiding device according to the embodiment of the present disclosure will be described. The guiding device according to the embodiment of the present disclosure includes: a roller guide frame 210; and at least one roller 218, 219 and 220 rotatably mounted to the roller guide frame 210, the at least one roller 218, 219, 220 being configured to roll on the guide rail of the elevator when the elevator car is moving; wherein the guiding device further includes a braking device, which inhibits the rotation of at least one roller 218, 219 and 220 when activated. According to the embodiment of the present disclosure, it is proposed to provide the braking device on the elevator guiding device to inhibit the rotation of the rollers, thereby suppressing and reducing the springing or vibrating of the elevator car when passengers enter and exit the elevator.

In the illustrated embodiment, the at least one roller includes a first roller 219 and a second roller 220 arranged side by side, wherein the first roller 219 and the second roller 220 have a gap G therebetween to accommodate the guide rail, or the first roller 219 and the second roller 220 may also be referred to as front-rear rollers. In addition, the guiding device also includes a third roller 218, which is a lateral roller. When the elevator car is traveling up and down, the first roller 219 and the second roller 220 roll on front and rear surfaces of the guide rail respectively, and the third roller 218 rolls on a side edge of the guide rail.

The first roller 219 and the second roller 229 are rotatably mounted on the roller guide frame 210 through the brackets 223 and 224 similar to those shown in FIG. 3, and the third roller 218 is also rotatably mounted on the roller guide frame 210 through the bracket 222. The spring mechanisms 62, 63 and 64 act on the rollers respectively so that the rollers tend to approach and engage with the guide rail. Although the number and specific arrangement of the rollers in the guiding devices are proposed in the illustrated embodiment, other numbers and arrangements of the rollers may be appropriately set in alternative embodiments according to actual conditions.

In the illustrated embodiment, the braking device includes: braking modules 41 and 51, pull wires 32 and 33, and a brake 31. The braking module 41 may include for example a friction member 42 capable of switching between a braking position and an idle position, wherein when the friction member 42 is in the braking position, the friction member 42 acts on at least one roller 219 by friction to inhibit the rotation of the at least one roller 219, and when the friction member 42 is in the idle position, it is separated from the at least one roller 219; the pull wire 32 is connected between the friction member 42 and the brake 31; the brake 31 is, for example, a device capable of performing linear displacement such as an electromagnet, which can pull the pull wire 32 to cause the friction member 42 of the braking module to move from the idle position to the braking position. In the embodiment shown in the drawings, the friction member 42 rotates, for example, around a pin 44 to thereby approach and contact the outer ring of the at least one roller 219, thereby inhibit the rotation of the at least one roller 219. In addition, a return spring 43 is provided to return the friction member 42 from the braking position to the idle position after the brake releases the friction member 42. In the guiding device according to the embodiment of the present disclosure, the brake 31 is connected to the braking modules through the pull wires 32 and 33, so that the braking modules are disposed close to each roller, and the brake 31 with a larger volume can be disposed away from the braking modules 41 and 51, thereby increasing the flexibility of the arrangement of the brake. In addition, in the braking device according to the present disclosure, the brake 31 can be used for multiple braking modules at the same time.

In some embodiments, the braking device includes: a first braking module 41 acting on the first roller 219 and a second braking module 51 acting on the second roller 220 respectively, wherein the first braking module and the second braking module are connected to the same brake 31 via the pull wires 32 and 33 respectively. In some embodiments, when the braking device is activated, it acts on both the first roller 219 and the second roller 220 simultaneously. In an alternative embodiment, a braking module that acts only on any one of the first roller, the second roller and the third roller may be provided, or a plurality of braking modules that act on any two or three of them respectively may be provided.

Figure 8:
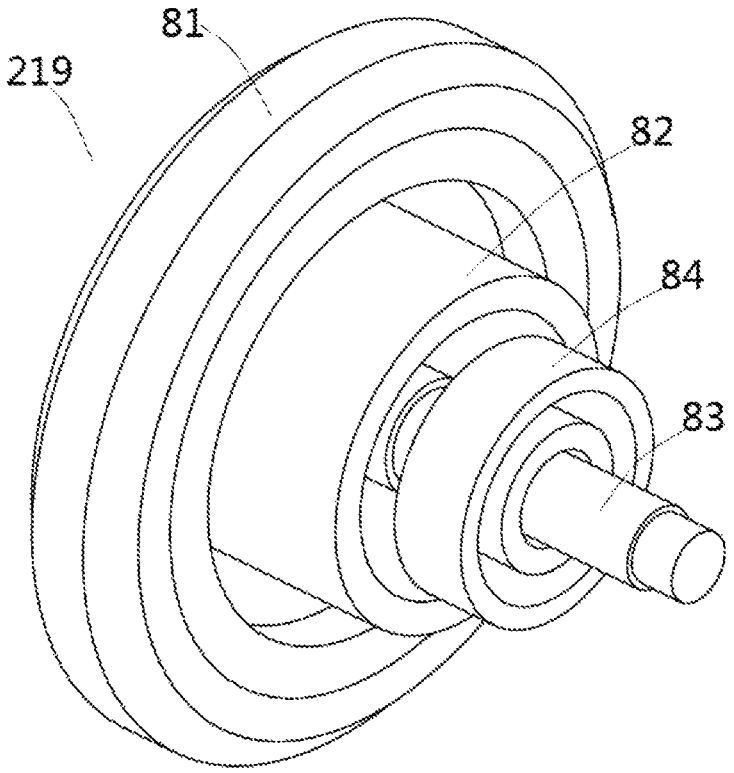
FIG. 8 is a perspective view of a roller according to an embodiment.

In the embodiments shown in FIGS. 4 to 7, the friction member acts on the outer ring of the roller body of the at least one roller, and it may be made of rubber material. In the embodiment shown in FIG. 8, the at least one roller 219 may include a roller hub 82, a roller outer ring 81 positioned on the hub 82, a roller shaft 83 and a bearing 84. The roller can be rotatably supported on the bracket through the bearing 84. In this embodiment, instead of the braking module that acts on the outer ring of the roller, the friction member of the braking module may also act on the hub 82 of the roller. The roller hub 82 may be made of a metal material, and may be rough so as to have a large friction force with the friction member that inhibits the rotation of the roller. In addition, in the illustrated embodiment, the hub 82 may extend beyond the roller outer ring 81 in the axial direction, thereby facilitating engagement with the friction member of the braking module.

Figure 9:
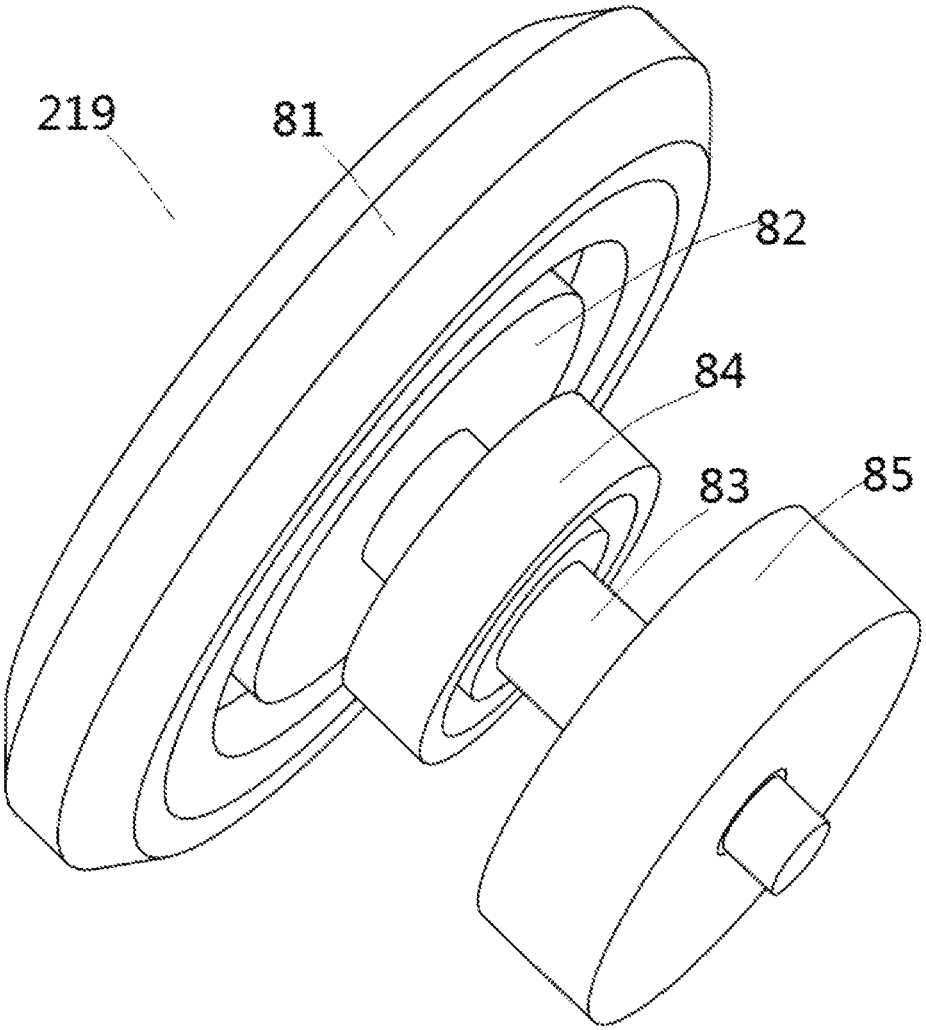
FIG. 9 is a perspective view of a roller according to another embodiment.

With continued reference to FIG. 9, in this embodiment, the at least one roller 219 may include: a roller hub 82, a roller outer ring 81 positioned on the hub 82, a roller shaft 83 and a bearing 84. The roller shaft 83 may include a portion on the back side of the bearing 84, and the friction member of the braking module may act on the roller shaft 83 of the at least one roller, for example, a portion of the roller shaft 83 on the back side of the bearing 84. Alternatively, an accessory 85 may be fixed on the roller shaft, and the friction member of the braking module may act on the accessory 85 on the rotating shaft of the at least one roller, wherein the accessory 85 and the roller hub 82 are located on both sides of the bearing 84.

According to another aspect, an elevator system is also provided, which includes: an elevator car; a tractor for driving the elevator car; and the guiding device for the elevator car according to various embodiments, which is connected to the elevator car to guide the elevator car to move along a guide rail. The tractor can be connected to the elevator car by a rope belt having a plurality of ropes integrated therein, in which case the guiding device according to the embodiment of the present disclosure is particularly required.

In some embodiments, the guiding device for the elevator car further includes: a control device, which is coupled with the braking device, and which is configured to activate the braking device when the elevator car is parked, and to release the braking device before the elevator car starts to move. In some embodiments, the control device is configured to activate the braking device after the elevator car is parked and during the opening of the door of the elevator car, and to release the braking device during the closing of the door of the elevator car and/or when the elevator is in a standby state. During the activation of the braking device, there is static friction between the rollers of the guiding device and the guide rail, which can effectively inhibit the movement of the elevator car along the guide rail, thereby ensuring that people will not feel the vibration of the elevator car in the longitudinal direction when entering or exiting the elevator if the elevator is parked. The control device may be integrated in the elevator system controller or may be a component separate from the elevator system controller, and may be mounted on the guiding device and accepts a signal sent from the elevator system controller regarding the start and stop of the elevator and/or opening and closing of the door, thereby determining the activation and release of the braking device. Alternatively, the control device may be connected to a sensor, such as a car door opening and closing sensor, to receive the opening and closing signal of the car door, thereby determining the activation and release of the braking device. Alternatively, the control device may be operated in other suitable ways.

The device according to the embodiment of the present disclosure has a simple and compact structure, is suitable for simple modification of existing products, and has a lower cost than other types of anti-vibration products.

Figure 10:
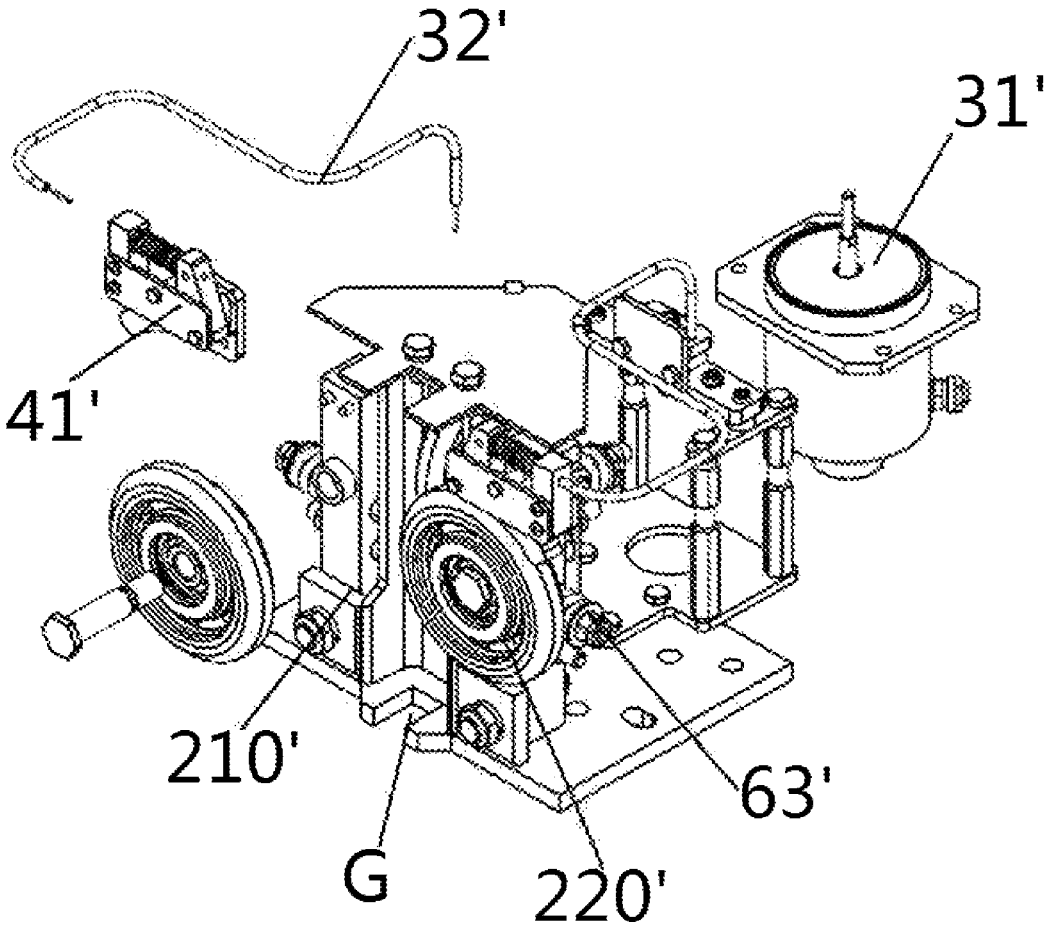
FIG. 10 is a schematic diagram of a partial explosion structure of the elevator rail clamping device according to one embodiment.
Figure 11:
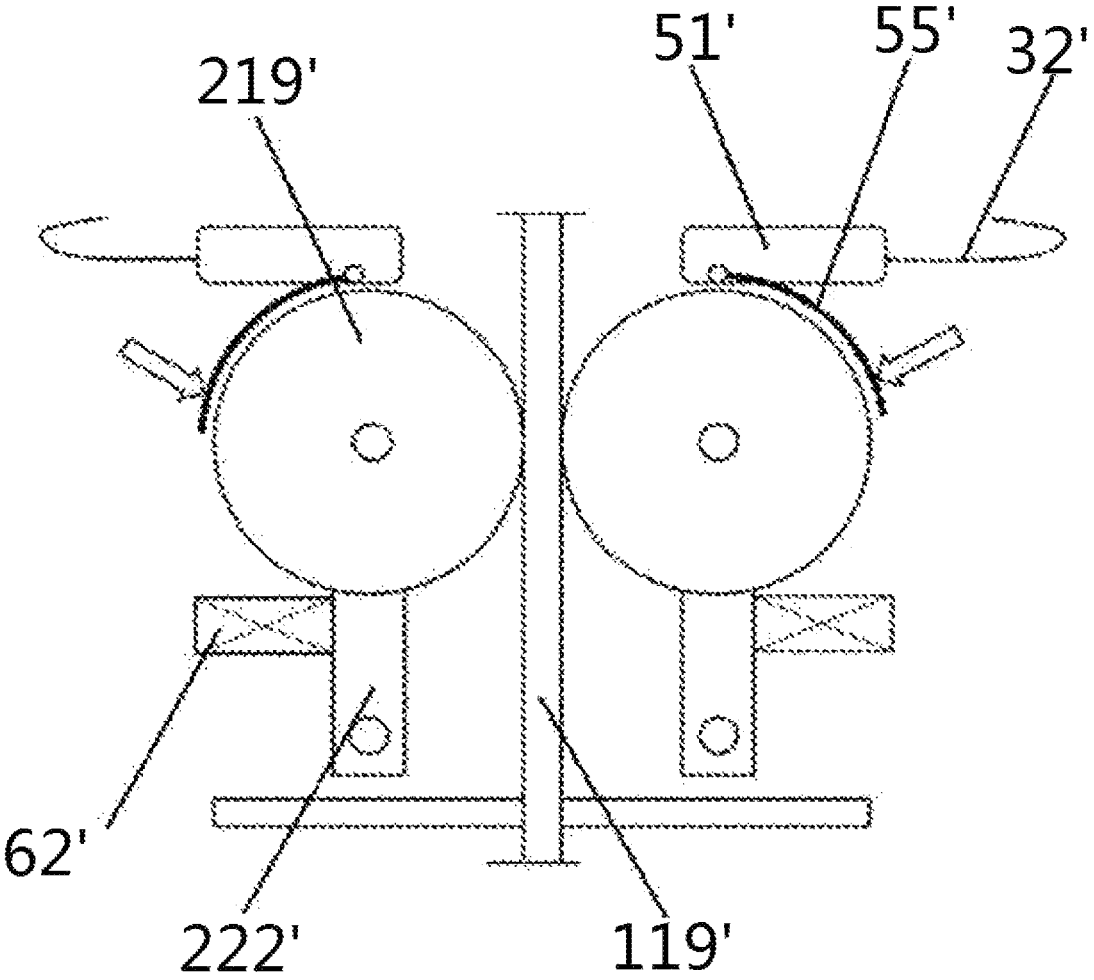
FIG. 11 is a schematic structural diagram of the elevator rail clamping device according to one embodiment.

Further referring to FIGS. 10 to 11, an elevator rail clamping device according to one embodiment is provided, which includes roller guide shoes and a braking device installed on the roller guide shoes; the braking device includes a brake or brake module 41',51', which is arranged on the roller guide shoe on one side of a guide wheel 219',220', the brake pad or friction member 52' on the brake 41', 51' is arranged close to the wheel edge of the guide wheel 219', 220'.

The roller guide shoe is installed on an elevator car and it includes a frame 210' and three guide wheels mounted on the frame 210'. The three guide wheels are all guide wheels for orientation, the sides of which are opposed to each other and enclose a clamping channel G. The central shaft of each guide wheel is connected to one end of the support brackets 222', and the other end of the support brackets 222' are against the springs 62', 63'. When the elevator guide rail 119' is placed in the channel G, the wheel edges of the three guide wheels are contacting the side wall of the guide rail 119' and the roller guide shoe thus is used to guide the car along the guide rail 119' of the elevator, ensuring the stability of the lifting movement of the car.

In this embodiment, the brake device is integrated on the existing roller guide shoe, and the brake pad 42', 52' of the brake device brakes the guide wheel 219', 220' on the roller guide shoe. When the elevator car moves up and down along the guide rail 119', only the guide wheels are in rolling connection with the surface of the guide rail 119', and the brake devices are separated from the guide rail 119'. When the car stops, only the brake pads 42', 52' of the brake device stop the rotation of the guide wheel. ensuring the stability of the car during parking and stopping of the car. This will not cause damage to the surface of the guide rail 119'. At the same time, since the brake device is integrated with the roller guide shoe, the installation space is greatly saved. When the brake device is regularly maintained, it is only necessary to directly remove the roller guide shoe from the car for maintenance operations. Therefore, the brake device also has the characteristics of convenient disassembly and subsequent replacement and maintenance.

Figure 12:
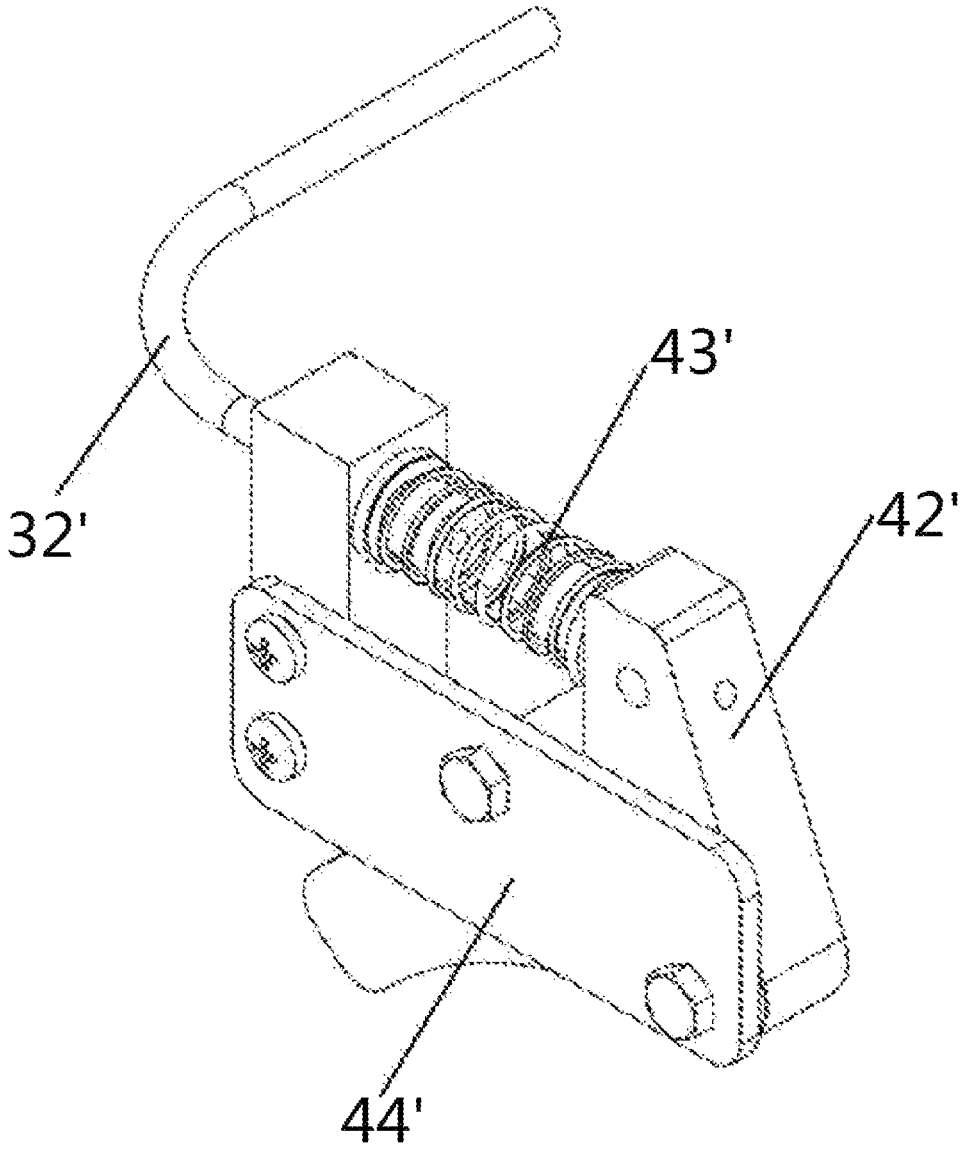
FIG. 12 is a schematic structural diagram of the brake according to one embodiment.

Furthermore, the brake device in one embodiment also includes a drive mechanism that matches the brake 41', 51'. Referring to FIG. 12, the brake 41' includes a brake box 44' and a brake pad 42'. The contacting surface of the brake pad 42' is curved, and the middle portion of the brake pad 42' is rotatably connected to the brake box 44'. The first end of the brake pad 42' is connected to the drive mechanism, and the second end of the brake pad 42' is arranged close to the edge of the guide wheel.

In one embodiment, the brake 41', 51' may be arranged on one side of at least one guide wheel on the roller guide shoe, so as to stop the rotation of the guide wheel when the car is stopped. When the brake 41', 51' brakes the guide wheel, the first end of the brake pad 42' is driven by the drive mechanism, so that the brake pad 41', 51' rotates along its middle portion, so that the second end of the brake pad 41', 51' is in contact with the side of the guide wheel, thereby prevent the guide wheel from further rotating. When it does not need to brake the guide wheel, the drive mechanism only needs to leave the brake 41', 51' to rotate in the opposite direction, so that the second end of the brake pad 42' is separated from the egde of the guide wheel.

Furthermore, in order to facilitate the control of the rotation of the brake pad by the drive mechanism, the shape of the brake pad may be of a "7" shape, and the drive mechanism may be a telescopic mechanism or a rotating mechanism without limitation. The telescopic end of the telescopic mechanism is connected to the first end of the brake pad or the output end of the rotating mechanism is connected to the first end of the brake pad through a cam so as to control the rotation of the brake pad 42'.

Furthermore, the drive mechanism in one embodiment includes a push-pull electromagnet 31' and a brake wire 32; the first end of the brake pad 42' is connected to one end of the brake wire 32', and the other end of the brake wire 32' is connected to the push-pull end of the push-pull electromagnet 31'.

When the brake 41', 51' is about to brake the guide wheel, the push-pull electromagnet 31' is energized, the push-pull end retracts, and the first end of the brake pad 42' is pulled by the brake wire 32', so that the second of the brake pad 42' is contacting the edge of the guide wheel to achieve braking.

As the brake wire 32' is shapeable rigid cable, it can be adapted to different installation structures. The push-pull action of the push-pull electromagnet 31' can be realized by the control of power transmission, so that the brake device formed by the push-pull electromagnet 31', the brake wire 32' and the brake 41', 51' can be applied to roller guide shoes of different sizes with low cost and easy integrated installation.

Furthermore, referring to FIG. 12, the brake 41', 51' in one embodiment further includes a compression spring 43'. The brake pad 42' is placed in the brake box 44'. The first end of the brake pad 42' is connected to one end of the compression spring 43', and the other end of the compression spring 43' is connected to an inner side wall of the brake box 44'. One end of the brake wire 32' passes through the compression spring 43' and is connected to the first end of the brake pad 42'.

Moreover, by providing a compression spring 43' between the first end of the brake pad 42' and the inner wall of the brake box 44', when it does not need to brake the guide wheel, i.e. when the push-pull electromagnet 31' does not exert a pulling force to the first end of the brake pad 42' by the brake wire 32', the compression spring 73 will recover, and thereby exert a thrust on the first end of the brake pad 42', so that the brake pad 42' rotates in an opposite direction along its middle portion, then the second end of the brake pad 42' is separated from the edge of the guide wheel.

Furthermore, in order to control the stability of the car during parking, two brakes 41', 51' are provided in one embodiment, and the two brakes 41', 51' are provided on one side of the two guide wheels respectively. The first end of each the brake pad 42' is connected to the push-pull electromagnet 31' through the brake wires 32'.

Moreover, the center axis of the first guide wheel and the second guide wheel may be parallel to each other, and the center axis of the third guide wheel may be perpendicular to the center axis of the first guide wheel.

Moreover, the two brakes 41', 51' are correspondingly arranged on one side of the first guide wheel and the second guide wheel, and the push-pull electromagnet 31' is installed on the corresponding side of the third guide wheel on the frame, such that the integrated installation of the roller guide shoe and the brake device is thus realized. The push-pull electromagnet 31' can drive the two brakes 41', 51' simultaneously, and synchronous brake control of the first guide wheel and the second guide wheel can be realized. The operation is simple, convenient, stable and reliable.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A guiding device for an elevator car, comprising:

a roller guide frame; and at least one roller rotatably mounted to the roller guide frame, the roller being configured to roll on an elevator guide rail when the elevator car is moving;

wherein the guiding device further comprises a braking device which inhibits the rotation of the roller when activated;

wherein the braking device comprises:

a braking module comprising a friction member capable of switching between a braking position and an idle position, wherein when the friction member is in the braking position, the friction member acts on the at least one roller by friction to inhibit the rotation of the at least one roller, and when the friction member is in the idle position, it is separated from the at least one roller;

a pull wire connected to the friction member; and a brake which is connected to the pull wire and which is capable of pulling the pull wire so as to cause the friction member of the braking module to move from the idle position to the braking position;

wherein the at least one roller comprises a first roller and a second roller arranged side by side, the first roller and the second roller have a gap therebetween to accommodate the guide rail, and when the braking device is activated, it acts on both the first roller and the second roller.

2. The guiding device for the elevator car according to claim 1, further comprising a control device, wherein the control device is coupled with the braking device, and the control device is configured to activate the braking device when elevator car is parked and release the braking device before the elevator car starts to move.

3. The guiding device for the elevator car according to claim 2, wherein the control device is configured to activate the braking device when the elevator car is parked and during the opening of the car door, and release the braking device during the closing of the car door and when the elevator is in a standby state.

4. The guiding device for the elevator car according to claim 1, wherein the braking device comprises a first braking module acting on the first roller and a second braking module acting on the second roller, and the first braking module and the second braking module are respectively connected to the same brake via the pull wire.

5. The guiding device for the elevator car according to claim 1, wherein the friction member acts on an outer ring of a roller body of the at least one roller.

6. The guiding device for the elevator car according to claim 1, wherein the friction member acts on a hub of the at least one roller.

7. The guiding device for the elevator car according to claim 1, wherein the friction member acts on a rotating shaft of the at least one roller or an accessory fixed to the rotating shaft of the at least one roller.

8. The guiding device for the elevator car according to claim 1, wherein the braking device comprises a braking module set on one side of the at least one roller, a brake pad of the brake module is arranged close to the edge of the at least one roller.

9. The guiding device for the elevator car according to claim 8, wherein the braking device further comprises a drive mechanism associated with the brake module; wherein the braking module includes a brake box and the brake pad which is curved, and the middle portion of the brake pad is rotatably connected to the brake box with the first end of the brake pad being connected to the drive mechanism, and the second end of the brake pad being arranged close to the edge of the at least one roller.

10. The guiding device for the elevator car according to claim 9, wherein the drive mechanism includes a push-pull electromagnet and a brake wire; the first end of the brake pad is connected to one end of the brake wire, and the other end of the brake wire is connected to the push-pull end of the push-pull electromagnet.

11. An elevator system, comprising:

an elevator car;

a tractor for driving the elevator car to move; and the guiding device for the elevator car according to claim 1, which is connected to the elevator car to guide the elevator car to move along the guide rail.

12. The elevator system according to claim 11, wherein the tractor is connected to the elevator car by a rope belt having a plurality of ropes integrated therein.

13. A guiding device for an elevator car, comprising:

a roller guide frame; and at least one roller rotatably mounted to the roller guide frame, the roller being configured to roll on an elevator guide rail when the elevator car is moving;

wherein the guiding device further comprises a braking device which inhibits the rotation of the roller when activated;

wherein the braking device comprises a braking module set on one side of the at least one roller, a brake pad of the brake module is arranged close to the edge of the at least one roller;

wherein the braking device further comprises a drive mechanism associated with the brake module; wherein the braking module includes a brake box and the brake pad which is curved, and the middle portion of the brake pad is rotatably connected to the brake box with the first end of the brake pad being connected to the drive mechanism, and the second end of the brake pad being arranged close to the edge of the at least one roller;

wherein the drive mechanism includes a push-pull electromagnet and a brake wire; the first end of the brake pad is connected to one end of the brake wire, and the other end of the brake wire is connected to the push-pull end of the push-pull electromagnet;

wherein the brake device further includes a compression spring; wherein the brake pad is placed in the brake box with the first end of the brake pad being connected to one end of the compression spring, and the other end of the compression spring being connected to an inner side wall of the brake box; wherein one end of the brake wire passes through the compression spring and is connected to the first end of the brake pad.

* * * * *